US011355040B2

(12) United States Patent
Sun et al.

(10) Patent No.: US 11,355,040 B2
(45) Date of Patent: Jun. 7, 2022

(54) METHOD AND TEST EQUIPMENT FOR INSPECTING FUNCTIONALITY OF DISPLAY DEVICE

(71) Applicant: NOVATEK Microelectronics Corp., Hsin-Chu (TW)

(72) Inventors: Sheng-Nan Sun, Hsinchu (TW); Jia-yu Wang, Hsinchu County (TW); Chi-Cheng Hung, Hsinchu County (TW); Kun-Yen Wu, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/095,697

(22) Filed: Nov. 11, 2020

(65) Prior Publication Data

US 2022/0148469 A1 May 12, 2022

(51) Int. Cl.
*G09G 3/00* (2006.01)

(52) U.S. Cl.
CPC ..... *G09G 3/006* (2013.01); *G09G 2310/00* (2013.01)

(58) Field of Classification Search
CPC ..... G09G 3/006; G09G 2310/00
See application file for complete search history.

(56) References Cited

U.S. PATENT DOCUMENTS

2002/0157033 A1* 10/2002 Cox ..... G09G 3/006 714/1
2010/0315681 A1* 12/2010 Misawa ..... H04N 1/32144 358/1.15

* cited by examiner

*Primary Examiner* — Mark W Regn
(74) *Attorney, Agent, or Firm* — Winston Hsu

(57) ABSTRACT

A method for inspecting functionality of a display device and a test equipment are provided. The method for inspecting functionality of the display device is utilized in a test equipment of an auto-test system. The method includes controlling an image capturing device to capture a test image shown on a screen of the display device for generating a captured image, acquiring an encoded pattern from the captured image and decoding the encoded pattern, wherein the test image is a source image generated by an image providing device superposed with the encoded pattern, determining whether the encoded pattern is successfully decoded to generate a resultant data, and comparing the resultant data with reference data to generate a comparison result after the encoded pattern is successfully decoded, wherein the reference data comprises information associated with the test image and information associated with system configuration of the display device.

11 Claims, 3 Drawing Sheets

METHOD AND TEST EQUIPMENT FOR INSPECTING FUNCTIONALITY OF DISPLAY DEVICE

BACKGROUND OF THE INVENTION

1. Field of the Invention

The present invention relates to a method for inspecting functionality of a display device and related test equipment, and more particularly, to a method for inspecting functionality of a display device and related test equipment capable of automatically performing display inspection without manual inspection.

2. Description of the Prior Art

With development of display technology, a display device, such as liquid crystal display (LCD), is widely applied in various electronic products, such as notebooks, desktop computers, televisions, mobile handsets. People frequently use electronic products whether they are at home or at work. Moreover, whether in manufacturing or non-manufacturing environments, the display inspection for dynamic image stabilization detection may usually rely on human visual inspection to check whether an abnormality of display has occurred at present. However, the human eyes may be incapable of making precise inspection for tiny scale pixels of the display device. Visual inspection errors, such as missing the abnormality of display or incorrectly judging the abnormality of display, may often occur since the human visual inspection is applied. Moreover, the manual inspection may also increase the human source cost in the manufacturing process. Thus, how to provide a better display inspection scheme without manual inspection has become an important issue in this art.

SUMMARY OF THE INVENTION

It is therefore an objective of the present invention to provide a method for inspecting functionality of a display device and related test equipment capable of automatically performing display inspection without manual inspection.

An embodiment of the present invention discloses a method for inspecting functionality of a display device utilized in a test equipment of an auto-test system comprising an image providing device, the test equipment and an image capturing device, the method comprising: controlling the image capturing device to capture a test image shown on a screen of the display device for generating a captured image; acquiring an encoded pattern from the captured image and decoding the encoded pattern, wherein the test image is a source image generated by the image providing device superposed with the encoded pattern; determining whether the encoded pattern is successfully decoded to generate a resultant data; and comparing the resultant data with reference data to generate a comparison result after the encoded pattern is successfully decoded, wherein the reference data comprises information associated with the test image and information associated with system configuration of the display device.

An embodiment of the present invention further discloses a test equipment for inspecting functionality of a display device, comprising: a processing circuit configured to execute instructions; and a storage device coupled to the processing circuit and storing the instructions executed by the processing circuit, wherein the instructions include:

controlling an image capturing device to capture a test image shown on a screen of the display device for generating a captured image; acquiring an encoded pattern from the captured image and decoding the encoded pattern, wherein the test image is a source image generated by an image providing device superposed with the encoded pattern; determining whether the encoded pattern is successfully decoded to generate a resultant data; and comparing the resultant data with reference data to generate a comparison result after the encoded pattern is successfully decoded, wherein the reference data comprises information associated with the test image and information associated with system configuration of the display device.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, hardware manufacturers may refer to a component by different names. This document does not intend to distinguish between components that differ in name but not function. In the following description and in the claims, the terms "include" and "comprise" are utilized in an open-ended fashion, and thus should be interpreted to mean "include, but not limited to". Also, the term "couple" is intended to mean either an indirect or direct electrical connection. Accordingly, if one device is coupled to another device, that connection may be through a direct electrical connection, or through an indirect electrical connection via other devices and connections.

Figure 1:
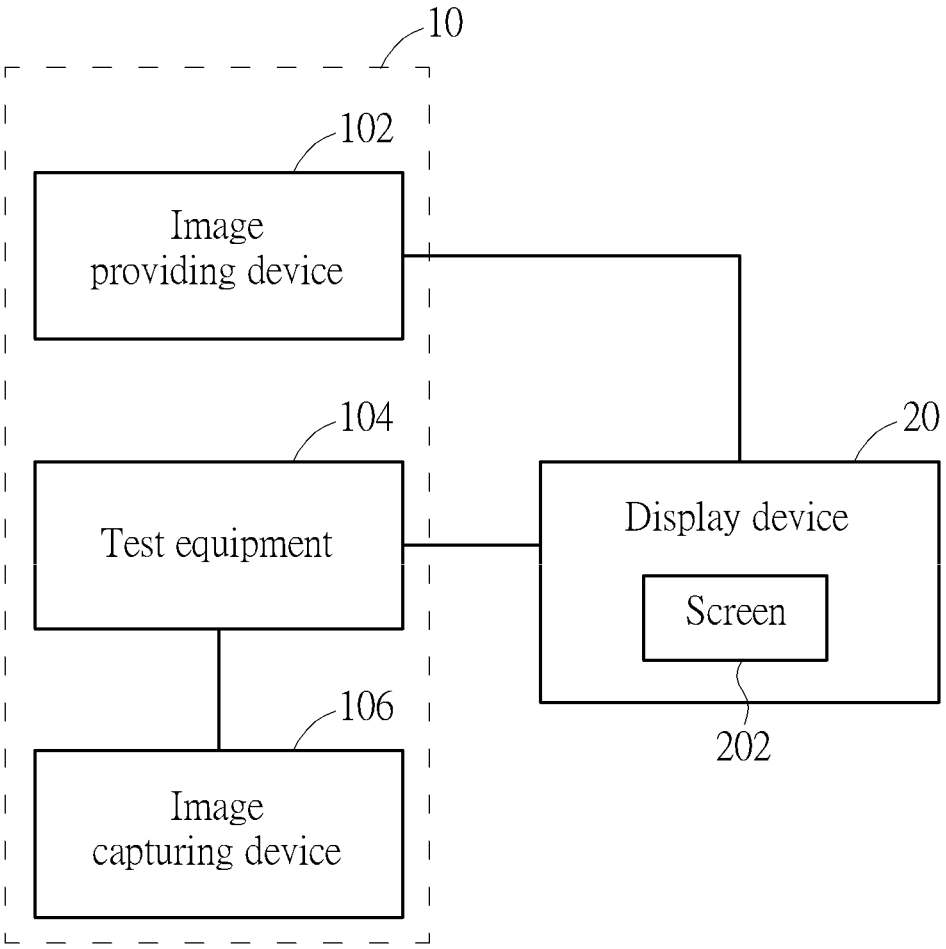
FIG. 1 is a schematic diagram of an automatic test system according to an exemplary embodiment of the present invention.

Please refer to FIG. 1, which is a schematic diagram of an automatic test system 10 according to an exemplary embodiment of the present invention. The automatic test system 10 may be utilized for inspecting functionality of a display device 20. For example, the display device 20 may be a liquid crystal display (LCD) or an organic light-emitting diode (OLED) display, but not limited thereto. The display device 20 being tested may be referred to as a device under test (DUT). The display device 20 includes a screen 202 for displaying image frames. The automatic test system 10 includes an image providing device 102, a test equipment 104 and an image capturing device 106. The image providing device 102 is configured to provide test images to the display device 20, such that the test images may be displayed on the screen 202 of the display device 20. The image providing device 102 may be a set-top box, a terrestrial analog television broadcast equipment or a multimedia storage device, but not limited thereto.

The test equipment 104 is configured to determine whether the functionality of the display device 20 is operating normally, and more specifically, to determine whether the display functionality of the screen 202 is operating normally and in addition, whether the system operation of the display device 20 is normal or not. The image capturing device 106 is configured to take pictures to generated captured images. The image capturing device 106 is controlled by the test equipment 104, and the image capturing device 106 may be a separate device connected to the test equipment 104 or embedded in the test equipment 104. The image capturing device 106 and the test equipment 104 may be independently disposed. The image providing device 102, the test equipment 104, the image capturing device 106 and the display device 20 may communicate with each other via a wireless or wired connection. For example, the test equipment 104 and the display device 20 may communicate through a data transmission interface. For example, the test equipment 104 may utilize transmission interface technologies, such as inter-integrated circuit ($I^2C$) bus interface, universal asynchronous receiver/transmitter (UART) interface, serial peripheral interface (SPI), universal serial bus (USB) interface, controller area network bus (CAN bus) interface, embedded display port (eDP) interface or any other transmission interface, to communicate with the display device 20 for signal transmission, but not limited thereto.

Figure 2:
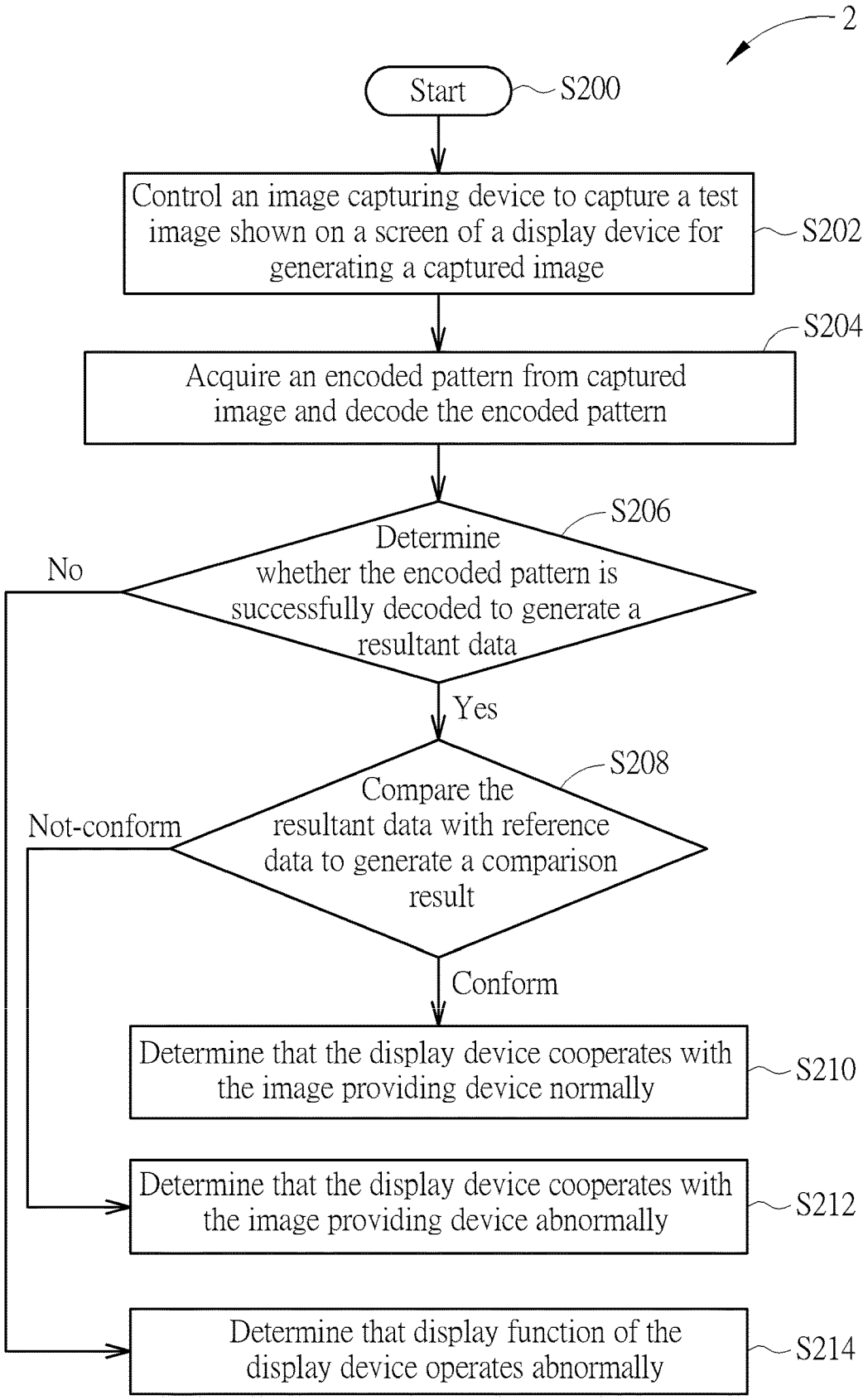
FIG. 2 is a flow diagram of a procedure according to an embodiment of the present invention.

For an illustration of the operations of the automatic test system 10, please refer to FIG. 2. FIG. 2 is a flow diagram of a procedure 2 according to an embodiment of the present invention. The flowchart in FIG. 2 mainly corresponds to the operations on the automatic test system 10 shown in FIG. 1. The procedure 2 includes the following steps:

Step S200: Start.

Step S202: Control an image capturing device to capture a test image shown on a screen of a display device for generating a captured image.

Step S204: Acquire an encoded pattern from captured image and decode the encoded pattern.

Step S206: Determine whether the encoded pattern is successfully decoded to generate a resultant data, if yes, go to Step S208; if not, go to Step S214.

Step S208: Compare the resultant data with reference data determine to generate a comparison result, and if the resultant data conforms to the reference data, go to Step S210; if the resultant data does not conform to the reference data, go to Step S212.

Step S210: Determine that the display device cooperates with the image providing device normally.

Step S212: Determine that the display device cooperates with the image providing device abnormally.

Step S214: Determine that display function of the display device operates abnormally.

According to the procedure 2, in Step S202, the automatic test system 10 operates in an automatic test operation mode. During the automatic test operation mode, the display device 20 is configured to display a test image on the screen 202 of the display device 20. The test equipment 104 is configured to control the image capturing device 106 to capture the test image shown on the screen 202 of the display device 20 for generating a captured image. The test image may be a source image superposed with an encoded pattern. For example, the image providing device 102 may superpose or overlay the encoded pattern on a source image that the image providing device 102 provides to generate a test image and transmit the test image to the display device 20. Alternatively, the test image may be generated by the display device 20. For example, the image providing device 102 transmits a source image to the display device 20, and the display device 20 may superpose the encoded pattern on the source image to generate a test image.

In an embodiment, during the automatic test operation mode, the test equipment 104 may control the display device 20 to display the test image. In an embodiment, the test equipment 104 may control the display device 20 to switch the image input source of the display device 20 from one image providing device 102 to another image providing device. For example, the test equipment 104 may transmit an input source control command to the display device 20 through a data transmission interface. The input source control command may be utilized for indicating switching image input source of the display device 20. After receiving the input source control command, the display device 20 is controlled to switch the image input source to acquire another test image according the input source control command and display the another test image on the screen 202.

During the automatic test operation mode, the image capturing device 106 is controlled to capture the test image shown on the screen 202 of the display device 20 for generating a captured image. For example, the test equipment 104 is configured to control the image capturing device 106 for capturing the test image shown on the screen 202 of the display device 20 to generate the captured image. The test equipment 104 may transmit a command to the image capturing device 106 to control the image capturing device 106 to take pictures after controlling the display device 20 to display the test image.

Figure 3:
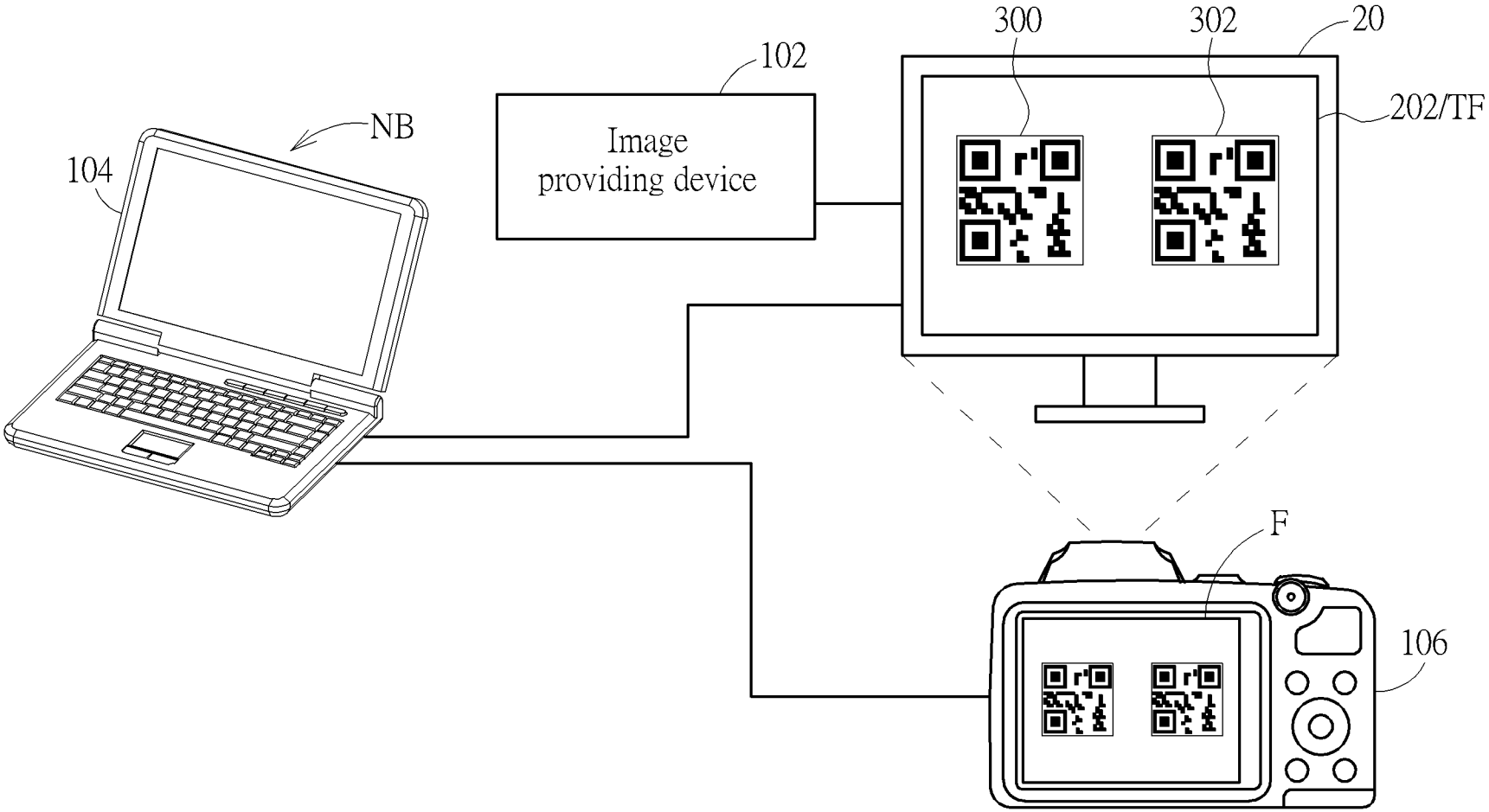
FIG. 3 is a schematic diagram of operations of the automatic test system according to an exemplary embodiment of the present invention.

For example, please refer to FIG. 3, which is a schematic diagram of operations of the automatic test system 10 according to an exemplary embodiment of the present invention. The test equipment 104 may be a computer, and the image capturing device 106 may be a camera. The image capturing device 106 may be placed near the screen 202 of the display device 20. The image capturing device 106 may be set to aim toward the screen 202 of the display device 20. Under such a situation, as shown in FIG. 3, a test image TF is displaying on the screen 202 of the display device 20. The image capturing device 106 may take a picture, i.e. generate a captured image F when the display device 20 is displaying the test image TF on the screen 202 of the display device 20. The captured image F is generated by the image capturing device 106 while the image capturing device 106 is set to capture a desired captured region on the screen 202. Therefore, the image capturing device 106 may record what is displayed on the screen 202 of the display device 20. The captured image F generated by the image capturing device 106 may be provided to the test equipment 104. For example, the image capturing device 106 may transmit the captured image F to the test equipment 104 via a wireless or wired connection.

In Step S204, the test equipment 104 is configured to acquire an encoded pattern from the captured image and decode the encoded pattern. The encoded pattern may be a barcode pattern or quick response (QR) code pattern, but not limited thereto. The test image may be a source image generated by the image providing device 102 superposed with the encoded pattern. The test equipment 104 may detect or identify whether an encoded code pattern exists in the captured image. When an encoded code pattern is detected, the test equipment 104 may decode the encoded pattern. For example, a QR code pattern, which is a pattern encoded by QR code, may include three position detection patterns located on three vertexes of a square. As such, a QR code pattern may be located by using the three identical position detection patterns on the upper left corner, upper right corner and lower left corner of the QR code pattern respectively. Each of the position detection patterns may be a smaller square mark or multiple square marks. The test equipment 104 may detect or identify whether the three position detection patterns are located in the captured image. When the three position detection patterns are detected in the captured image, the location and orientation of the encode pattern may be determined according to the relationship among the three position detection patterns. A region including the three detected position detection patterns in the captured image may be determined as an encoded pattern by the test equipment 104. After recognition of the encoded pattern, the test equipment 104 may decode the encoded pattern. For example, as show in FIG. 3, the test image including encoded patterns 300 and 302 which are QR code patterns is displayed on the screen 202, such that the captured image F may include at least one of the encoded patterns 300 and 302, and the existed encoded pattern may be detected and decoded. The contents that are encoded in the encoded patterns 300 and 302 may be different. For example, the encoded pattern 300 may be generated by encoding an image, and the encoded pattern 302 may be generated by encoding system information, such as the image resolution provided by the image providing device 102, encoding scheme of the image providing device 102, or system information of the display device 20 such as memory usage of the display device 20.

In Step S206, the test equipment 104 is configured to determine whether the encoded pattern is successfully decoded to generate a resultant data. The resultant data means decoded data, which may be decoded image content or decoded system information. When an encoded pattern is recognized and the encoded pattern is successfully decoded to generate a resultant data (i.e., decoded data), the test equipment 104 determines that a successful decoding is performed. In response to determining that the encoded pattern is successfully decoded, the test equipment 104 may determine that a display function of the display device 20 operates normally. Then, Step S208 is executed.

In Step S206, when an encoded pattern is recognized and the encoded pattern cannot be successfully decoded to generate the resultant data, the test equipment 104 may determine that an unsuccessful decoding is performed. In response to that the encoded pattern is unsuccessfully decoded, in Step S214 the test equipment 104 may determine that a display function of the display device 20 operates abnormally.

In Step S208, in response to determining that the encoded pattern is successfully decoded to generate the resultant data, the test equipment 104 is configured to compare the resultant data with reference data to generate a comparison result. That is, the test equipment 104 is configured to determine whether the resultant data (i.e., decoded data) conforms the reference data. The reference data may include data same as source image content or system information encoded in the encoded pattern(s).

When the comparison result indicates that the resultant data conforms to the reference data, in Step S210 the test equipment 104 determines that the display device 20 cooperates with the image providing device 102 normally. This means that the display inspection for the display device 20 is successfully completed and the display device 20 has passed the display inspection. In an alternative embodiment, when the comparison result indicates that the resultant data conforms to the reference data, the test equipment 104 may determine whether all the test images for inspection have been displayed. If there is any other test image for inspection has not been displayed, the test equipment 104 may control the display device 20 to switch to display another test image or switch from the current image providing device 102 to another image providing device and control the image capturing device 106 to capture another other image. Then, Step S210 is executed until all the test images for inspection have been displayed. In addition, when the comparison result indicates that the resultant data does not conform to the reference data, in Step S212 the test equipment 104 is configured to determine that the display device 20 cooperates with the image providing device 102 abnormally.

Those skilled in the art should readily make combinations, modifications and/or alterations on the abovementioned description and examples. The abovementioned description, steps, procedures and/or processes including suggested steps can be realized by means that could be hardware, software, firmware (known as a combination of a hardware device and computer instructions and data that reside as read-only software on the hardware device), an electronic system or combination thereof. An example of the means may be the test equipment 104. Examples of hardware can include analog, digital and/or mixed circuits known as microcircuit, microchip, or silicon chip. For example, the hardware may include ASIC(s), field programmable gate array(s) (FPGA(s)), programmable logic device(s), coupled hardware components or combination thereof. In another example, the hardware may include general-purpose processor(s), microprocessor(s), controller(s), digital signal processor(s) (DSP(s)) or combination thereof. Examples of the software may include set(s) of codes, set(s) of instructions and/or set(s) of functions retained (e.g., stored) in a storage device, e.g., a non-transitory computer-readable medium. The non-transitory computer-readable storage medium may include read-only memory (ROM), flash memory, random access memory (RAM), subscriber identity module (SIM), hard disk, floppy diskette, or CD-ROM/DVD-ROM/BD-ROM, but not limited thereto. Examples of the electronic system may include a system on chip (SoC), system in package (SiP), a computer on module (CoM), a computer program product, an apparatus, a mobile phone, a laptop, a tablet computer, an electronic book or a portable computer system and the test equipment 104.

Any of the abovementioned procedures and examples above may be compiled into program codes or instructions that are stored in a non-transitory storage device. For example, the test equipment 104 may include a processing circuit and a non-transitory storage device coupled to the processing circuit. The storage device may store program codes or instructions, accessed and executed by the processing circuit. The processing circuit may read and execute the program codes or the instructions stored in the non-transitory storage device for realizing the abovementioned functions. Moreover, the test equipment 104 may be any computer device which includes the processing circuit and the non-transitory storage device and is capable of executing the program codes or the instructions of the abovementioned procedures and examples for realizing the abovementioned functions.

To sum up, the test equipment of the embodiments of the invention can control the image capturing device to capture the test image shown on the screen of the display device to generate the captured image, and can recognize that the display function of the display device under test operates normally or not by determining whether an encoded pattern included in the captured image can be decoded to generate the corresponding decoded data matching the preset reference data. Thus, a fully automatic inspection for the display device without manual inspection is provided, and complex calculation procedures and large database for data comparison may be reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for inspecting functionality of a display device utilized in a test equipment of an auto-test system comprising an image providing device, the test equipment and an image capturing device, the method comprising:

controlling the image capturing device to capture a test image shown on a screen of the display device for generating a captured image;

acquiring an encoded pattern from the captured image and decoding the encoded pattern, wherein the test image is a source image generated by the image providing device superposed with the encoded pattern;

determining whether the encoded pattern is successfully decoded to generate a resultant data;

determining that a display function of the display device operates normally in response to that the encoded pattern is successfully decoded; and comparing the resultant data with reference data to generate a comparison result after the encoded pattern is successfully decoded, wherein the reference data comprises information associated with the test image and information associated with system configuration of the display device.

2. The method of claim 1, further comprising:

switching the image providing device to another image providing device by sending a command to the image providing device through the display device.

3. The method of claim 1, wherein the superposition of the encoded pattern is performed in the image providing device or the display device.

4. The method of claim 1, further comprising:

determining that the display function of the display device operates abnormally in response to that the encoded pattern is not successfully decoded.

5. The method of claim 1, further comprising:

determining that the display device cooperates with the image providing device normally in response to the comparison result indicating that the resultant data conforms to the reference data.

6. The method of claim 1, further comprising:

determining that the display device cooperates with the image providing device abnormally in response to the comparison result indicating that the resultant data does not conform to the reference data.

7. A test equipment for inspecting functionality of a display device, comprising:

a processing circuit configured to execute instructions; and a storage device coupled to the processing circuit and storing the instructions executed by the processing circuit, wherein the instructions comprise:

controlling an image capturing device to capture a test image shown on a screen of the display device for generating a captured image;

acquiring an encoded pattern from the captured image and decoding the encoded pattern, wherein the test image is a source image generated by an image providing device superposed with the encoded pattern;

determining whether the encoded pattern is successfully decoded to generate a resultant data;

determining that a display function of the display device operates normally in response to that the encoded pattern is successfully decoded; and comparing the resultant data with reference data to generate a comparison result after the encoded pattern is successfully decoded, wherein the reference data comprises information associated with the test image and information associated with system configuration of the display device.

8. The test equipment of claim 7, wherein the instructions further comprise:

switching the image providing device to another image providing device by sending a command to the image providing device through the display device.

9. The test equipment of claim 7, wherein the instructions further comprise:

determining that the display function of the display device operates abnormally in response to that the encoded pattern is not successfully decoded.

10. The test equipment of claim 7, wherein the instructions further comprise:

determining that the display device cooperates with the image providing device normally in response to the comparison result indicating that the resultant data conforms to the reference data.

11. The test equipment of claim 7, wherein the instructions further comprise:

determining that the display device cooperates with the image providing device abnormally in response to the comparison result indicating that the resultant data does not conform to the reference data.

* * * * *